United States Patent [19]

Sato et al.

[11] 4,390,194

[45] Jun. 28, 1983

[54] RECORDING MATERIAL

[75] Inventors: Atsushi Sato, Tokyo; Isoo Shimizu; Naoya Takahashi, both of Yokohama, all of Japan

[73] Assignee: Nippon Petrochemicals Company, Limited, Tokyo, Japan

[21] Appl. No.: 276,708

[22] Filed: Jun. 23, 1981

[30] Foreign Application Priority Data

Jun. 25, 1980 [JP] Japan ..... 55-86191

[51] Int. Cl.[3] ..... B41M 5/16; B41M 5/22

[52] U.S. Cl. ..... 282/27.5; 427/150; 427/151; 428/320.6; 428/320.8; 428/914

[58] Field of Search ..... 282/27.5; 427/150, 151; 428/320.4, 320.6, 320.8, 913, 914, 411, 537; 106/21

[56] References Cited

U.S. PATENT DOCUMENTS 3,836,383 9/1974 Kiritani et al. ..... 282/27.5

3,936,566 2/1976 Sato et al. ..... 282/27.5

4,144,279 3/1979 Sato et al. ..... 585/422

FOREIGN PATENT DOCUMENTS 55-63292 12/1980 Japan ..... 282/27.5

1406107 9/1975 United Kingdom ..... 282/27.5

*Primary Examiner*—Bruce H. Hess

*Attorney, Agent, or Firm*—Scully, Scott, Murphy and Presser

[57] ABSTRACT

A recording material prepared by using a solvent mixture which has excellent dissolving property for dye-precursors and which gives high color developing rate and high developed color density. The recording material comprises a sheet material having thereon a layer of microcapsules containing an electron donating dye-precursor and a solvent mixture for said dye-precursor, and is characterized in that said solvent mixture consists essentially of 5 to 50 wt % of 1-methyl-3-phenylindane and 95 to 50 wt % of at least one kind of diarylalkanes.

6 Claims, No Drawings

RECORDING MATERIAL

BACKGROUND OF THE INVENTION (1) Field of the Invention

This invention relates to a recording material. More particularly, the invention relates to a pressure-sensitive recording material which comprises a sheet material having thereon a layer of microcapsules containing an electron donating dye-precursor and a specific solvent mixture for the dye-precursor. The specific solvent mixture consists of 1-methyl-3-phenylindane and at least one of diarylalkanes.

(2) Description of the Prior Art

Several kinds of pressure-sensitive recording materials are hitherto well known. For example, to one sheet of paper are applied microcapsules containing a solution of an electron donating colorless chromogenic substance (hereinafter referred to as "dye-precursor"), and to another sheet of paper is applied an electron accepting substance such as clay or polymeric material (hereinafter referred to as "color developer") which produces a color upon reacting with the dye-precursor. When the recording materials are used, the treated surfaces of the above sheets are put together face to face and local pressure is applied to the paired papers by handwriting or typewriting, thereby obtaining desired duplicate impressions.

The recording mechanism in the pressure-sensitive recording material of the type described above is such that the microcapsules are ruptured by the pressure of handwriting or the impact of typewriting to release the dye-precursor solution from the microcapsules. The solution containing a dye-precursor comes into contact with the color developer on the opposing surface of the other sheet of paper to produce a color.

In another type of known recording material, the microcapsule layer is applied to one side of a sheet of paper as an inner layer, and a color developer is then applied as an outer layer over the microcapsule layer. Similarly, when it is used, the microcapsules on this recording material are ruptured by the pressure of handwriting or typewriting and the dye-precursor solution is released from the microcapsules, which solution comes into contact with the color developer in the outer layer to produce a color.

The dye-precursor solution that is used for the recording material of this kind is a solution of an electron donating dye-precursor in one or more kinds of hydrophobic solvents. The hydrophobic solvents employed here are required to have the properties such as innoxiousness, absence of disagreeable odor, colorlessness or quite light color, non-volatility, good dissolving property (solvent power) for dye-precursors and good stability when a dye-precursor is dissolved therein. It is further required that, in the preparation of microcapsules, a very fine and stable dispersion of the solution can be produced; microcapsule membranes can be formed around the fine particles of the dispersion; the obtained microcapsules have good storage stability; the membranes of microcapsules are uniform and of desired thickness; the solvent does not inhibit the color-producing reaction between a dye-precursor and a color developer with a high reaction rate; when the base paper is coated with a polymeric material as a color developer, the solvent dissolves the polymeric material to cause close contact with the dye-precursor; duplicate impressions are clear without runs; and that duplicate impressions can be maintained as they stand for a long period of time without changing.

In the prior art, polychlorinated biphenyl was widely used as the solvent for producing the microcapsules of these pressure-sensitive recording materials. The polychlorinated biphenyl has indeed several excellent properties as the solvent of this kind; however, it has a serious disadvantage in that it is quite toxic and its accumulation in the human body can cause several disorders. Therefore, when the recording material having a microcapsule layer containing the polychlorinated biphenyl is handled in the production process and used in recording, it may cause serious health problems. Accordingly, the polychlorinated biphenyl is no longer being used. As the solvents to replace polychlorinated biphenyl, there are proposed and used, for example, diarylalkanes such as 1-phenyl-1-xylylethane and 1-phenyl-1-(ethylphenyl)ethane, alkylnaphthalene and alkylbiphenyl (U.S. Pat. No. 3,936,566—A. Sato et al.; U.S. Pat. No. 3,836,383—M. Kiritani et al.) However, these solvents are not satisfactory in view of their dissolving property for dye-precursors, especially for black dye-precursors. Also proposed is the use of alkylarylindane obtained as a dimer of styrene or the like (British Pat. No. 1,406,107—Monsanto Co.; Japanese Laid-Open Patent Publication No. 55-63292—Asahi Dow). However, in these solvents, the color developing rate and developed color density are insufficient.

BRIEF SUMMARY OF THE INVENTION

It is, therefore, the primary object of the present invention to provide an improved recording material in which a specific solvent mixture which is free from the above-described disadvantages is used.

Another object of the present invention is to provide a recording material which has an excellent color developing rate and gives clear and dense duplicate images.

A further object of the present invention is to provide a recording material which is prepared by using a specific solvent mixture for dissolving a dye-precursor, which solvent mixture has neither toxicity nor disagreeable odor and has excellent dissolving property and color developing characteristics, and gives good storage stability of microcapsules and recording materials.

In accordance with the present invention, the recording material comprises a sheet material having thereon a layer of microcapsules containing an electron donating dye-precursor and a specific solvent mixture for the dye-precursor. The above specific solvent mixture consists of 1-methyl-3-phenylindane and at least one member of diarylalkanes.

Among diarylalkanes, diarylmethane and diarylethane are preferable, and even more preferable is arylphenylethane. The carbon atom number of the diarylalkane is preferably not higher than 18.

The preferable diarylmethane and diarylethane are represented by the following general formula:

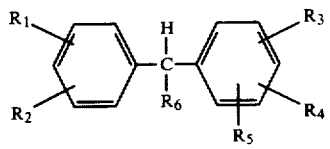

wherein $R_1$ to $R_5$ is a hydrogen atom or an alkyl group having 1 to 4 carbon atoms, $R_6$ is a hydrogen atom or a methyl group, and the total number of the carbon atoms of $R_1$ to $R_6$ is an integer from 1 to 5, inclusive.

More particularly, the diarylalkanes are exemplified by 1-phenyl-1-xylylmethane, 1,1-diphenylethane, 1,1-bis(ethylphenyl)ethane, 1,1-dixylylethane, 1-phenyl-1-xylylethane, 1-phenyl-1-tolylethane, 1-phenyl-1-ethylphenylethane, 1-phenyl-1-methylethylphenylethane, 1-phenyl-1-isopropylphenylethane, and 1-phenyl-1-butylphenylethane. Among them, especially preferable compounds are those having 16 or 17 carbon atoms. As the diarylalkanes, they can be used either alone or in combination.

DETAILED DESCRIPTION OF THE INVENTION

Diarylalkane can easily be prepared by reacting styrene or alkylstyrene with benzene or alkylbenzene in the presence of an acid catalyst such as sulfuric acid or silica alumina. The method for preparing the diarylalkanes is disclosed in detail in U.S. Pat. No. 4,144,279 (A. Sato et al.)

The above-mentioned 1,1-bis(ethylphenyl)ethane can be separated from the by-product oil obtained in the preparation of ethylbenzene. 1-methyl-3-phenylindane can be prepared by dimerizing styrene in the presence of a solid acid catalyst such as silica alumina.

Diarylalkanes are good solvents and they almost meet the requirements for solvents described above. However, their dissolving property relative to special and useful black dye-precursors is not always satisfactory.

Meanwhile, 1-methyl-3-phenylindane readily dissolves these black dye-precursors; however, the color developing rate becomes low when it is used.

It might be supposed that, when a diarylalkane and 1-methyl-3-phenylindane are mixed together, the obtained mixture would retain an average of the properties of both solvents. Contrary to expectations, however, it has been found that the advantageous properties of both solvents are maintained in the obtained mixture, and their drawbacks are obviated to give unexpected effects. The mixing ratio which produces the best effects is 95 to 50 wt % of diarylalkanes to 5 to 50 wt % of 1-methyl-3-phenylindane.

The solvent mixture used in this invention is excellent in dissolving property for dye-precursors as compared with the well known hydrocarbon solvents such as alkylbenzenes, naphthene, and paraffin and various kinds of plant oils, which do not contain chlorine. Though the use of petroleum fractions (e.g. those having boiling points in the range of 135° to 260° C.) containing aromatic hydrocarbons has been proposed, they have disagreeable odor, their dissolving properties for dye-precursors are inadequate, and their color developing rates are low. Further, there are proposed polycyclic hydrocarbons such as alkylbiphenyl, partially hydrogenated terphenyl, and alkylnaphthalene; however, their color developing rates are lower than that of the solvent mixture of the present invention.

The solvent mixture of the present invention is quite excellent because it is non-toxic (unlike chlorinated biphenyl), has no disagreeable odor and has several other properties which are desirable for solvent. In addition, the solvent mixture of the present invention has a high boiling point and is non-volatile, so the microcapsules can be preserved for a long time after the preparation. When a solvent is used, generally 1 to 7%, preferably 3 to 5%, of a dye-precursor is dissolved into the solvent, at which the solvent mixture of the present invention has sufficient dissolving property for the material to be dissolved.

As the dye-precursors, there are typically triarylmethane type compounds, diphenylmethane type compounds, xanthene type compounds, thiazine type compounds, and spiropyran type compounds.

The dye-precursors of triarylmethane type are exemplified by 3,3-bis(p-dimethylaminophenyl)-6-dimethylaminophthalide (Crystal Violet Lactone);
3,3-bis(p-dimethylaminophenyl)phthalide;
3-(p-dimethylaminophenyl)-3-(1,2-dimethylindole-3-yl)-phthalide;
3-(p-dimethylaminophenyl)-3-(2-methylindole-3-yl)phthalide;
3-(p-dimethylaminophenyl)-3-(2-phenylindole-3-yl)phthalide;
3,3-bis(1,2-dimethylindole-3-yl)-5-dimethylaminophthalide;
3,3-bis(1,2-dimethylindole-3-yl)-6-dimethylaminophthalide;
3,3-bis(9-ethylcarbazole-3-yl)-5-dimethylaminophthalide;
3,3-bis(2-phenylindole-3-yl)-5-dimethylaminophthalide; and
3-p-dimethylaminophenyl-3-(1-methylpyrrole-2-yl)-6-dimethylaminophthalide.

The diphenylmethane type dye-precursors are exemplified by 4,4-bis-dimethylaminobenzhydrine benzyl ether;
N-halophenyl leuco Auramine; and
N-2,4,5-trichlorophenyl leuco Auramine.

The xanthene type dye-precursors are exemplified by
Rhodamine B-anilinolactam;
Rhodamine B-(p-nitroanilino)lactam;
Rhodamine B-(p-chloroanilino)lactam;
3-dimethylamino-6-methoxyfluoran;
3-diethylamino-7-methoxyfluoran;
3-diethylamino-7-chloro-6-methylfluoran;
3-diethylamino-7-(acetylmethylamino)fluoran;
3-diethylamino-7-(dibenzylamino)fluoran;
3-diethylamino-7-(methylbenzylamino)fluoran;
3-diethylamino-7-(chloroethylmethylamino)fluoran;
3-diethylamino-7-(diethylamino)fluoran; and
3-diethylamino-6-methyl-7-anilinofluoran.

The thiazine type dye-precursors are exemplified by benzoyl leuco methylene blue and p-nitrobenzyl leuco methylene blue.

The spiro type dye-precursors are exemplified by
3-methyl-spiro-dinaphthopyran;
3-ethyl-spiro-dinaphthopyran;
3,3'-dichloro-spiro-dinaphthopyran;
3-benzyl-spiro-dinaphthopyran;
3-methylnaphtho-(3-methoxybenzo)spiropyran; and
3-propyl-spiro-dibenzodipyran.

As the electron accepting color developers, there are clay, polymers, and aromatic carboxylic acids or their metal salts. The polymers are exemplified by phenol-aldehyde polymer, phenol-acetylene polymer, maleic acid-rosin polymer, partially or completely hydrolyzed styrene-maleic anhydride copolymer, partially or completely hydrolyzed ethylene-maleic anhydride copolymer, carboxy polyethylene, and partially or completely hydrolyzed vinyl methyl ether-maleic anhydride copolymer.

The examples of aromatic carboxylic acids and their derivatives are disclosed in Japanese Laid-Open Patent Publication No. 55-28847. That is, the total carbon atom number of the aromatic carboxylic acid is 15 or more, preferably 19 or more. Examples of such carboxylic acids are 3,5-di(α-methylbenzyl)salicylic acid;
3-(α-methylbenzyl)-5-(α,α-dimethylbenzyl)salicylic acid;
3-(4'-α',α'-dimethylbenzyl)phenyl-5-(α,α-dimethylbenzyl)-salicylic acid;
3,5-di-tert-butyl salicylic acid;
3,5-di-tert-octyl salicylic acid;
3-cyclohexyl-5-(α,α-dimethylbenzyl)salicylic acid;
3-phenyl-5-(α,α-dimethylbenzyl)salicylic acid; and
3,5-di(α,α-dimethylbenzyl)salicylic acid.

Further, their salts of polyvalent metals such as zinc, aluminum, barium, tin, iron, calcium, and lead can also be used.

As the method to prepare the microcapsules from the dye-precursor solution, which is obtained by dissolving a dye-precursor into the solvent mixture, there is a coacervation method in which the fine particles of the dye-precursor solution that are dispersed in water are coated by a protective colloidal material such as gelatine or gum arabic, thereby obtaining the microcapsules which contain therein the dye-precursor solution. Another method is the interfacial polymerization method in which a monomer of an intermediate or partially condensed product is employed and a polymerization initiator, an accelerator or a catalyst is added to cause the polymerization on the surfaces of fine paticles of the dye-precursor solution, thereby preparing the microcapsules containing the dye-precursor solution. The solvent mixture of the present invention can be used in both of the above methods.

In the practical process for preparing microcapsules in the conventional art, an auxiliary solvent has been used in dissolving a dye-precursor in order to control the viscosity and volatility of the dye-precursor solution, the particle size of the fine dispersion in microcapsule formation, the dissolving property to the polymeric material that is coated onto the surface to be recorded, and the rate of color development. However, the solvent mixture of the present invention can satisfactorily be used without employing such an auxiliary solvent. Nevertheless, any solvent which does not degrade the characteristics of the solvent mixture of the present invention may be used as an auxiliary solvent as long as it is not more than 2 parts by weight relative to 1 part by weight of the solvent mixture of the invention. It should be noted that the solvent mixture of the present invention can be used together with the above-described conventional solvent.

EXAMPLES AND COMPARATIVE EXAMPLES (a) Solvents and Solvent Mixtures

Solvents and solvent mixtures (hereinafter simply referred to as "solvents") from A to E were prepared. Their compositions were as follows:

| | |
|---|---|
| Solvent A: | |
| 1-phenyl-1-(2,4-dimethylphenyl)ethane | 80 wt % |
| 1-methyl-3-phenylindane | 20 wt % |
| Solvent B: | |
| 1-phenyl-1-xylylethane | 75 wt % |
| 1-phenyl-1-ethylphenylethane | 15 wt % |
| 1-methyl-3-phenylindane | 10 wt % |
| Solvent C: | |
| 1-methyl-3-phenylindane | (Single solvent) |
| Solvent D: | |
| 1-phenyl-1-(2,4-dimethylphenyl)ethane | (Single solvent) |
| Solvent E: | |
| Diisopropylnaphthalene | (Single solvent) |

Solvents A and B are examples of the present invention, and Solvents C, D, and E are comparative examples.

(b) Test of Dissolving Properties for Dye-Precursors

Using 3-diethylamino-6-methyl-7-anilinofluoran as a black dye-precursor, the dissolving properties of the solvents were tested according to the following method.

The above dye-precursor was added to each of the above solvents. The concentrations of the dye-precursor were varied in the range of 1 wt % to 3 wt %, in increments of 0.5 wt %. The dye-precursor was completely dissolved by heating, and the solutions were then allowed to stand at room temperature, where the states of recrystallization of the dye-precursor in the solutions were observed. The results of the above tests are shown in Table 1.

TABLE 1

| Solvent | Concentration of Dye-Precursor (wt %) | | | | |
|---|---|---|---|---|---|
| | 1.0 | 1.5 | 2.0 | 2.5 | 3.0 |
| A | O | O | O | O | O |
| B | O | O | O | O | O |
| C | O | O | O | O | O |
| D | O | O | * | * | * |
| E | O | O | * | * | * |

O: Completely dissolved
*: Suspended substance observed

It will be understood from the above Table 1 that, as compared with Solvent D of diarylalkane alone, Solvents A and B containing 1-methyl-3-phenylindane are excellent in dissolving property as in the case of Solvent C of only 1-methyl-3-phenylindane. For comparison, a conventional solvent (Solvent E) was tested, which was poor in dissolving property.

(c) Preparation of Pressure-Sensitive Recording Material

Microcapsules were prepared by the coacervation method using Solvents A to E and the dye-precursor used in the foregoing paragraph (b).

Three parts by weight of each Solvent were mixed with one part by weight of an auxiliary solvent of kerosene (made by Nippon Petrochemicals Co., Ltd.; Trademark: Nisseki No. 3 Ink Oil), to which was added the dye-precursor to prepare a 3% dye-precursor solution. A blender was fed with 1 wt % aqueous solution of polyvinyl methyl ether-maleic anhydride copolymer and 11% aqueous sol of gelatine. The above dye-precursor solution was added into the blender and the operation was continued until fine dispersion particles having diameter of about 5 microns or smaller were obtained. The mixing ratio of the above was 60 parts by weight of the copolymer solution, 136 parts by weight of the gelatine sol and 187 parts by weight of the dye-precursor solution.

To the above-obtained emulsified mixture were added 91 parts by weight of an aqueous solution of gum arabic. Further, it was diluted by adding with stirring 725 parts by weight of water with pH adjustment to about 9.0. Then, the pH was gradually lowered to 4.6 by addition of 10% acetic acid solution, thereby separating out the coacervate and depositing it around the fine dispersion particles. After this procedure of microcapsule formation, the membranes of microcapsules were cured by adding a glutaraldehyde solution to complete the microcapsule preparation. Satisfactory microcapsules were obtained according to the above precedure.

The microcapsules obtained in the above procedure were coated onto the surfaces of paper sheets to prepare the upper sheets of pressure-sensitive recording materials. To the surfaces of the other sheets (lower sheets) to be used in combination with the upper sheets, phenol-aldehyde copolymer (color developer) was applied.

(d) Measurement of Color Developing Rates and Color Densities

The surfaces of the upper sheets coated with the microcapsules were opposed to the surfaces of the lower sheets coated with color developer. The combinations of the upper sheets and the lower sheets prepared by using the foregoing solvents were pressed by using a calender roll to give a certain load of pressure so as to develop the color. After 1 minute and again after 2 hours from the start of this color developing treatment, the reflection coefficients of the color-developed surfaces of lower sheets were measured by using a reflection type spectrophotometer. The color densities were calculated by the following equation:

$$\text{Color Density} = \left(1 - \frac{RC\text{-}II}{RC\text{-}I}\right) \times 100$$

where RC-I is the reflection coefficient of a lower sheet which was not subjected to the color developing treatment, and RC-II is the reflection coefficient of a color-developed lower sheet.

The results of the foregoing tests are shown in Table 3 below. The symbols used in Table 3 represent the color densities which are indicated in Table 2 below.

TABLE 2

| Symbol | Color Density after 1 min. | Color Density after 2 hours |
|---|---|---|
| ◎ | 60 or more | 70 or more |
| ○ | 55-59 | 65-69 |
| Δ | 45-54 | 60-64 |
| X | 44 or less | 59 or less |

TABLE 3

| Solvent | Color Density after 1 min. | Color Density after 2 hours |
|---|---|---|
| A | ◎ | ◎ |
| B | ◎ | ◎ |
| C | Δ | Δ |

TABLE 3-continued

| Solvent | Color Density after 1 min. | Color Density after 2 hours |
|---|---|---|
| D | ○ | ○ |
| E | Δ | ○ |

It will be understood from the above results that both the color developing rate and the final color density are excellent when the solvent mixture of the present invention is used for preparing the microcapsules.

What is claimed is:

1. A recording material comprising a sheet material having thereon a layer of microcapsules containing an electron donating dye-precursor and a solvent mixture for said dye-precursor, characterized in that said solvent mixture consists essentially of 5 to 50 wt % of 1-methyl-3-phenylindane and 95 to 50 wt % of at least one diarylalkane.

2. The recording material as claimed in claim 1, wherein said diarylalkanes are represented by the general formula:

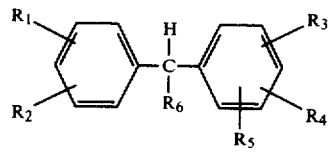

wherein $R_1$ to $R_5$ is a hydrogen atom or an alkyl group having 1 to 4, inclusive, carbon atoms, $R_6$ is a hydrogen atom or a methyl group, and the total number of the carbon atoms of $R_1$ to $R_6$ is an integer from 1 to 5, inclusive.

3. The recording material as claimed in claim 2, wherein said diarylethane is at least one member selected from the group consisting of 1-phenyl-1-xylylmethane, 1,1-diphenylethane, 1,1-bis(ethylphenyl)ethane, 1,1-dixylylethane, 1-phenyl-1-xylylethane, 1-phenyl-1-tolylethane, 1-phenyl-1-ethylphenylethane, 1-phenyl-1-methylethylphenylethane, 1-phenyl-1-isopropylphenylethane, and 1-phenyl-1-butylphenylethane.

4. The recording material as claimed in claim 1, wherein one part by weight of said solvent mixture is used as a mixture with not more than two parts by weight of a solvent selected from the group consisting of a petroleum fraction, a synthetic oil and a plant oil.

5. The recording material as claimed in claim 4, wherein said petroleum fraction is kerosene.

6. The recording material as claimed in claim 4, wherein said synthetic oil is at least one member selected from the group consisting of alkylbiphenyls, partially hydrogenated terphenyls and alkylnaphthalenes.

* * * * *